US007818896B2

(12) United States Patent
Hsieh et al.

(10) Patent No.: US 7,818,896 B2
(45) Date of Patent: Oct. 26, 2010

(54) SOLE VENTILATION SYSTEM

(76) Inventors: Kan-zen Hsieh, Baichi, Huian, Fujian (CN); Chao Hsin Chang, 1230 Bird Rd., Coral Gables, FL (US) 33146-1110

( * ) Notice: Subject to any disclaimer, the term of this patent is extended or adjusted under 35 U.S.C. 154(b) by 599 days.

(21) Appl. No.: 11/864,942

(22) Filed: Sep. 29, 2007

(65) Prior Publication Data

US 2009/0083995 A1 Apr. 2, 2009

(51) Int. Cl.
*A43B 7/06* (2006.01)
*A43B 13/20* (2006.01)

(52) U.S. Cl. ..... 36/3 B; 36/29

(58) Field of Classification Search ..... 36/3 B, 36/3 A, 3 R, 29, 35 B
See application file for complete search history.

(56) References Cited

U.S. PATENT DOCUMENTS 5,477,626 A * 12/1995 Kwon ..... 36/3 B
7,395,615 B2 * 7/2008 Lee ..... 36/29
7,681,329 B2 * 3/2010 Fu ..... 36/3 B
2005/0178023 A1 * 8/2005 Hammonds ..... 36/3 B
2007/0209233 A1 * 9/2007 Kim et al. ..... 36/27
2008/0229623 A1 * 9/2008 Ferretti ..... 36/3 B
2009/0151203 A1 * 6/2009 Boyer et al. ..... 36/3 B
2009/0282704 A1 * 11/2009 Park ..... 36/3 B
2010/0132228 A1 * 6/2010 Polegato Moretti ..... 36/3 B

* cited by examiner

*Primary Examiner*—Ted Kavanaugh

(57) ABSTRACT

A sole includes a base having a first gasbag and a second gasbag respectively received therein. The first gasbag and the second gasbag communicate with each other by multiple windpipes. Multiple through holes are respectively and laterally defined in two opposite walls of the base and respectively communicating with the first cavity and the second cavity. Each through hole has a check valve mounted therein. A first airtight cover is mounted to the first gasbag for closing the first gasbag and a second airtight cover is mounted to the second gasbag for closing the second gasbag. The first airtight cover has a blowing hole defined therein and communicates with the first gasbag. The second airtight cover has multiple blowing holes defined therein and communicating with the second gasbag. A ventilative insole connected to the first airtight cover.

6 Claims, 3 Drawing Sheets

SOLE VENTILATION SYSTEM

BACKGROUND OF THE INVENTION

1. Field of the Invention

The present invention relates to sole, and more particularly to a sole that is ventilative and waterproof.

2. Description of Related Art

Most of the shoes are made of leather or rubber. The space in the shoe becomes warm and moist after being used for a period of time such that the germs and moulds are propagated in the shoe. The wearer always feels uncomfortable and muggy, especially in summer.

The present invention has arisen to mitigate and/or obviate the disadvantages of the conventional shoes.

SUMMARY OF THE INVENTION

The main objective of the present invention is to provide an improved sole that is ventilative and waterproof.

To achieve the objective, the sole in accordance with the present invention comprises a base having a first gasbag and a second gasbag respectively received therein. The first gasbag and the second gasbag communicate with each other by multiple windpipes. Multiple through holes are respectively and laterally defined in two opposite walls of the base and respectively communicating with the first cavity and the second cavity. Each through hole has a check valve mounted therein. A first airtight cover is mounted to the first gasbag for closing the first gasbag and a second airtight cover is mounted to the second gasbag for closing the second gasbag. The first airtight cover has a blowing hole defined therein and communicates with the first gasbag. The second airtight cover has multiple blowing holes defined therein and communicating with the second gasbag. A ventilative insole connected to the first airtight cover.

Further benefits and advantages of the present invention will become apparent after a careful reading of the detailed description with appropriate reference to the accompanying drawings.

DETAILED DESCRIPTION OF THE INVENTION

Figure 1:
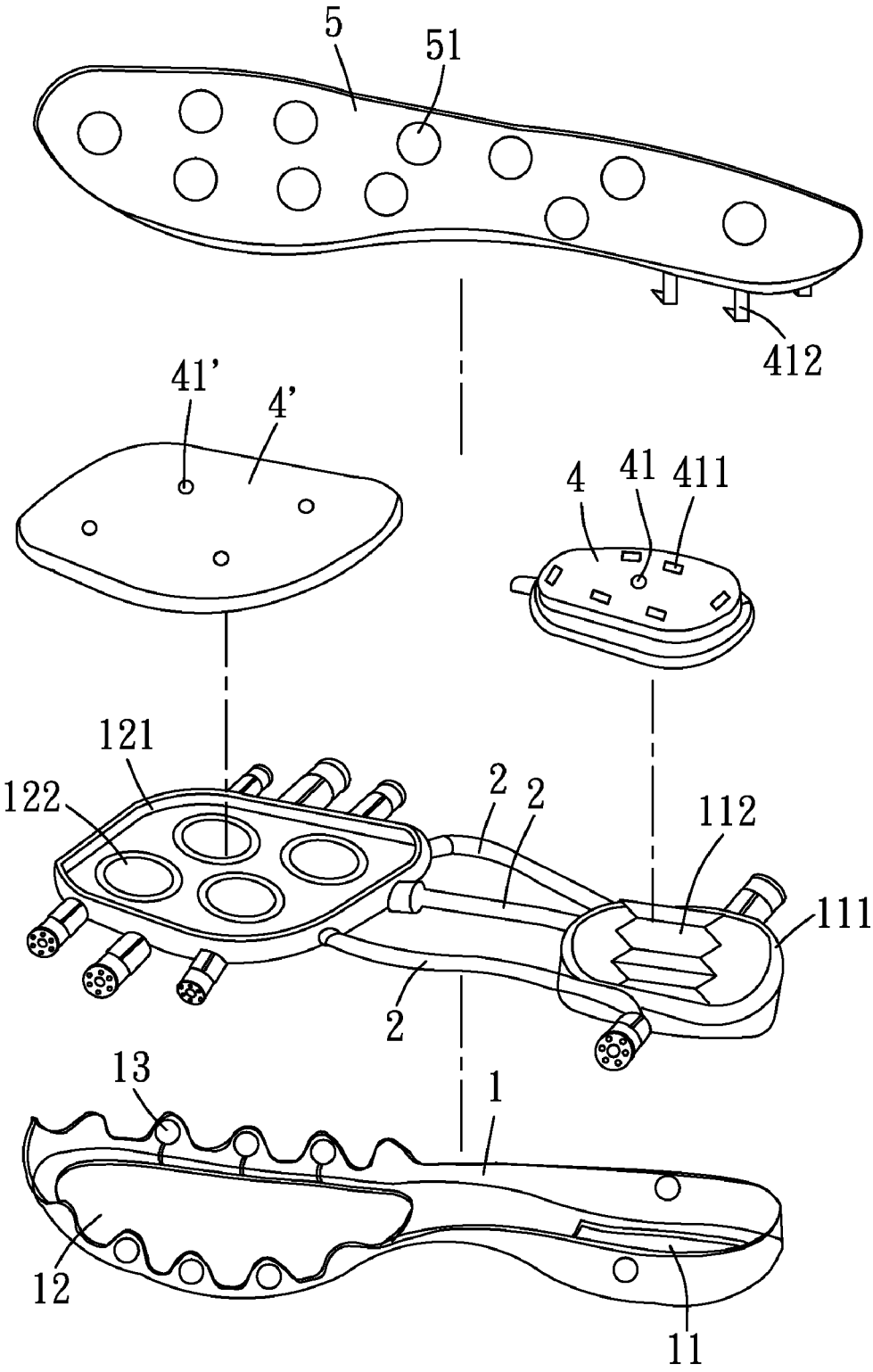
FIG. 1 is a perspective view of a sole in accordance with the present invention.
Figure 2:
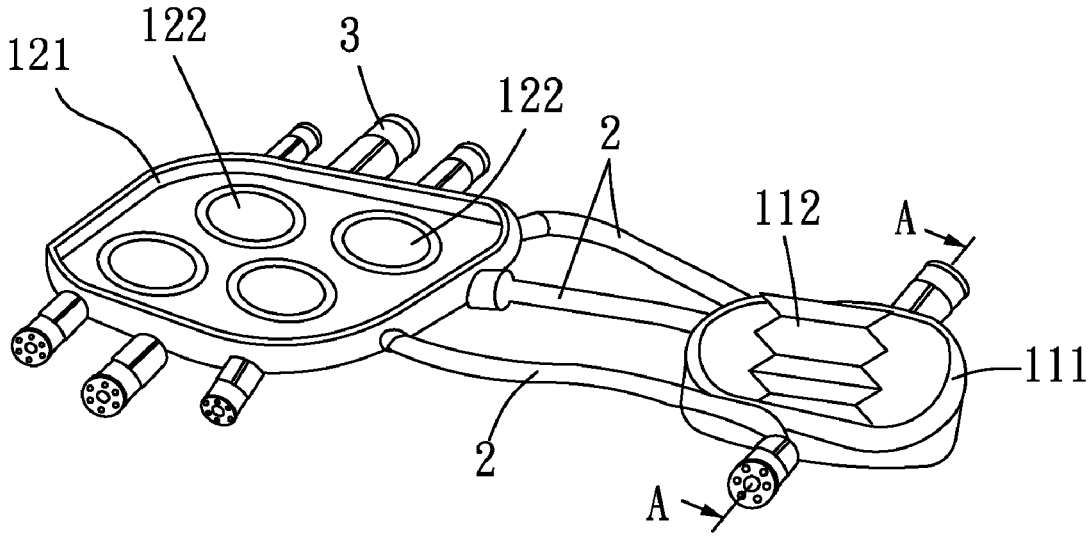
FIG. 2 is a partially perspective view of the sole in accordance with the present invention.

Referring to the drawings and initially to FIGS. 1-5, a sole in accordance with the present invention comprises a base (1) having a first cavity (11) defined in a rear portion thereof. A first gasbag (111) is received in the first cavity (11). A second cavity (12) is defined in a front portion of the base (1) and a second gasbag (121) is received in the second cavity (12). The first gasbag (111) and the second gasbag (121) communicate with each other by multiple windpipes (2). Multiple through holes (13) are respectively and laterally defined in two opposite walls of the base (1) and respectively communicating with the first cavity (11) and the second cavity (12). Each through hole (13) has a check valve (3) mounted therein. A first airtight cover (4) is mounted to the first gasbag (111) for closing the first gasbag (111) and a second airtight cover (4') is mounted to the second gasbag (121) for closing the second gasbag (121). The first airtight cover (4) has a blowing hole (41) defined therein and communicating with an inner periphery of the first gasbag (111). Multiple bores (411) is defined in a top face of the first airtight cover (4). Multiple blowing holes (41') are defined in the second airtight cover (4') and communicating with an inner periphery of the second gasbag (121). An insole (5) is connected to the first airtight cover (4) before using the sole in accordance with the present invention. The insole (5) has multiple buckles (412) downward extending therefrom and each buckle (412) is engaged in a corresponding one of the multiple bores (411) for holding the insole (5) in place. The insole (5) includes multiple ventilate holes (51) defined therein and communicating with the blowing holes (41, 41') in the first airtight cover (4) and the second airtight cover (4').

Figure 4:
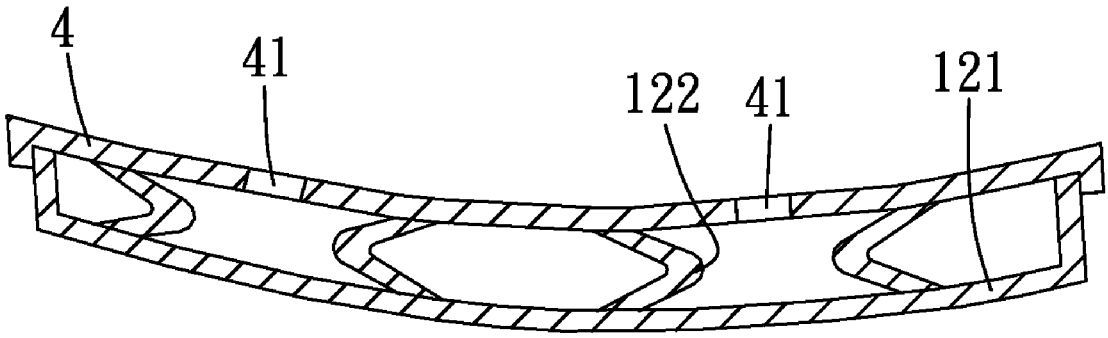
FIG. 4 is a cross-sectional view of a second gasbag of the sole in accordance with the present invention.
Figure 5:
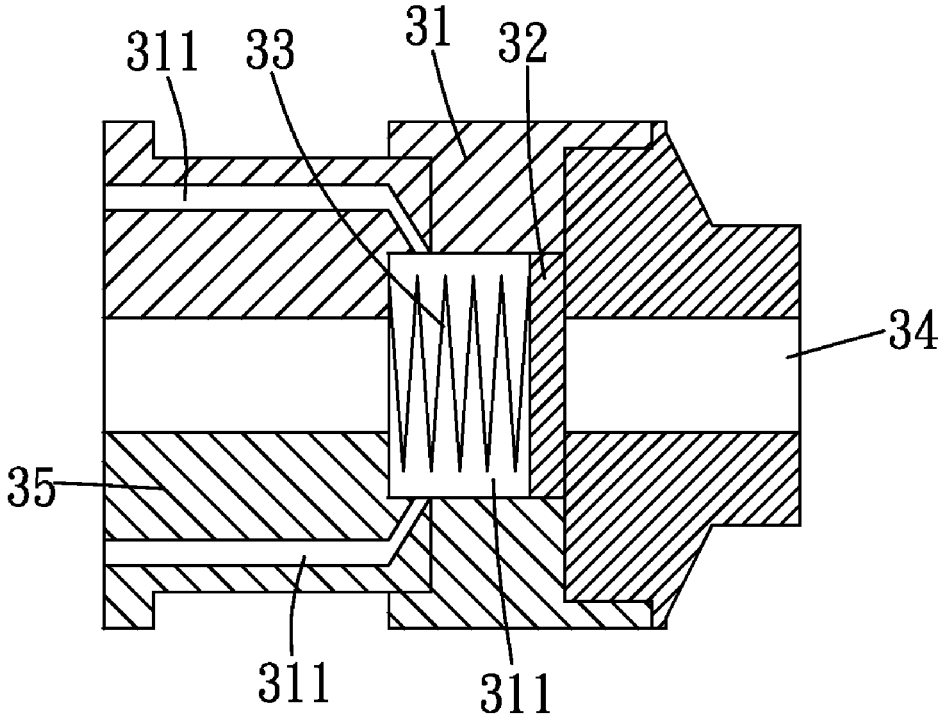
FIG. 5 is a cross-sectional view of a check valve of the sole in accordance with the present invention.

The second airtight cover (4') has multiple blowing holes (41') defined therein and communicating with an inner periphery of the second gasbag (121). The second gasbag (121) has multiple resilient supports (122) upwardly extending from a bottom thereof. Each resilient support (122) has a cylindrical structure and aligns with a corresponding on of the multiple blowing holes (41') in the second airtight cover (4'), as shown in FIG. 4. Each resilient support (122) has a top abutting a lower face of the second airtight cover (4') for enhancing the restitution force of the second airtight cover (4').

The first gasbag (111) has a cylindrical structure and two opposite telescopic walls (112) formed thereon for enhancing the restitution force of the first gasbag (111). In addition, the blowing hole (41) in the first airtight cover (4) centrally corresponding to the first gasbag (111).

Figure 3:
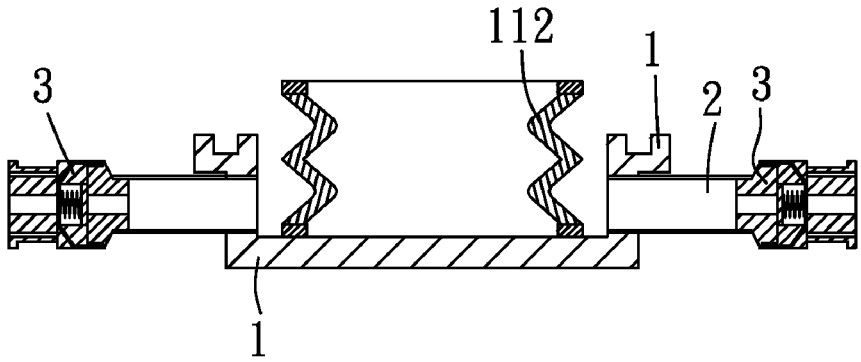
FIG. 3 is a is a partially cross-sectional view of the sole in accordance with the present invention along line A-A in FIG. 2.

The check valve (3) has a body (31) has through hole (311) centrally and longitudinally defined therein. An outlet nozzle (34) and an exhaust nozzle (35) are respectively and longitudinally mounted to two opposite ends of the body (31). A seal pad (32) is reciprocally movably received in the through hole (311) in the body (31) for selectively closing the outlet nozzle (34). A spring (33) is received in the through hole (311) in the body (31). The spring (33) has two opposite ends respectively abutting against the seal pad (32) and the exhaust nozzle (35) for providing a restitution force to the seal pad (32). Multiple exhaust passages (311) are defined in the exhaust nozzle (35) and communicate with the through hole (31) in the body (31). With reference to FIG. 3, the check valves (3), corresponding to the first cavity (11), are connected to a corresponding one of the multiple windpipes (2).

In addition, the check valve (3) further includes a flash lamp mounted in the passage (311) and an aromatic device is disposed in the first gasbag (111).

When walking, the sole in accordance with the present invention has a ventilate circle as followed due to a walk form of a human. 1. The first gasbag (111) exhausts to the heel when the first gasbag (111) is slightly pressed. 2. The first gasbag (111) exhausts to the second gasbag (121) when the pressure from the heel is raised and the blowing hole (41) in the first airtight cover (4) is closed by the heel. P 3. The second gasbag (121) exhausts to the thenar when the second gasbag (121) is slightly pressed or in a free condition. 4. The second gasbag (121) exhausts via the check valves (3) corresponding to the second cavity (12) when the pressure from the thenar is raised and the blowing holes (41') in the second airtight cover (4') is closed by the thenar. 5. The first gasbag (111) and the second gasbag (121) automatically inhale due to the restitution force thereof when the first gasbag (111) and the second gasbag (121) are in a free condition. As a result, the sole in accordance with the present invention automatically ventilates during operation to advantageously alter the conventional shoes.

Although the invention has been explained in relation to its preferred embodiment, it is to be understood that many other possible modifications and variations can be made without departing from the spirit and scope of the invention as hereinafter claimed.

What is claimed is:

1. A sole comprising a base having a first cavity defined in a rear portion thereof, a first gasbag received in the first cavity, a second cavity defined in a front portion of the base and a second gasbag received in the second cavity, the first gasbag and the second gasbag communicating with each other by multiple windpipes, multiple through holes respectively and laterally defined in two opposite walls of the base and respectively communicating with the first cavity and the second cavity, each through hole having a check valve mounted therein, a first airtight cover mounted to the first gasbag for closing the first gasbag and a second airtight cover mounted to the second gasbag for closing the second gasbag, the first airtight cover having a blowing hole defined therein and communicating with an inner periphery of the first gasbag, the second airtight cover having multiple blowing holes defined therein and communicating with an inner periphery of the second gasbag, an insole connected to the first airtight cover before using, the insole including multiple ventilate holes defined therein and communicating with the blowing holes in the first airtight cover and the second airtight cover.

2. The sole as claimed in claim 1, wherein the first airtight cover has multiple bores defined in a top face of the first airtight cover and the insole has multiple buckles downward extending therefrom, each buckle engaged in a corresponding one of the multiple bores for holding the insole in place, the second gasbag having multiple resilient supports upwardly extending from a bottom thereof, each resilient support having a cylindrical structure and aligns with a corresponding on of the multiple blowing holes in the second airtight cover, each resilient support having a top abutting a lower face of the second airtight cover for enhancing the restitution force of the second airtight cover.

3. The sole as claimed in claim 1, wherein the first gasbag has a cylindrical structure and two opposite telescopic walls formed thereon for enhancing the restitution force of the first gasbag, the blowing hole in the first airtight cover centrally corresponding to the first gasbag.

4. The sole as claimed in claim 1, wherein the check valve includes a body having a through hole centrally and longitudinally defined therein, an outlet nozzle and an exhaust nozzle respectively and longitudinally mounted to two opposite ends of the body, a seal pad reciprocally movably received in the through hole in the body for selectively closing the outlet nozzle, a spring received in the through hole in the body, the spring having two opposite ends respectively abutting against the seal pad and the exhaust nozzle for providing a restitution force to the seal pad, multiple exhaust passages defined in the exhaust nozzle and communicating with the through hole in the body, the check valves corresponding to the first cavity connected to a corresponding one of the multiple windpipes.

5. The sole as claimed in claim 4, wherein the check valve further comprises a flash lamp mounted therein.

6. The sole as claimed in claim 1 further comprising an aromatic device disposed in the first gasbag.

* * * * *